United States Patent [19]

Fiori, Jr.

[11] Patent Number: 4,838,139

[45] Date of Patent: Jun. 13, 1989

[54] MUSICAL KEYBOARD

[75] Inventor: David Fiori, Jr., Yardley, Pa.

[73] Assignee: Sensor Technologies, Inc., Bensalem, Pa.

[21] Appl. No.: 840,935

[22] Filed: Mar. 18, 1986

[51] Int. Cl.[4] ..... G10H 1/18; G10H 1/34

[52] U.S. Cl. ..... 84/1.1; 84/1.27; 84/DIG. 7; 336/79; 334/75; 341/32

[58] Field of Search ..... 336/79; 334/75; 84/1.09, 1.1, 1.15, 1.27, DIG. 7, DIG. 10, 1.01, 1.24; 340/365 L; 341/32

[56] References Cited

U.S. PATENT DOCUMENTS 4,425,511 1/1984 Brosh ..... 336/79 X

OTHER PUBLICATIONS

MIDI Specification I.O, Copyright 1983, IMA 8426 Vine Valley Drive, Sun Valley, CA 91352.

*Primary Examiner*—S. J. Witkowski

*Attorney, Agent, or Firm*—Nixon & Vanderhye

[57] ABSTRACT

A musical keyboard having keys which carry metal spoilers that alter the resonance characteristics of tank circuits associated with the keys as the keys move toward and away from the inductance coils of the tank circuits. The tank circuits are connected sequentially to a frequency sensing circuit which develops indications of key positions by sensing the resonance frequency of each tank circuit.

23 Claims, 3 Drawing Sheets

MUSICAL KEYBOARD

DESCRIPTION OF THE INVENTION

2. Technical Field

The present invention relates, in general, to the electronic production of music and, in particular, to a musical keyboard having inductance coil sensors which sense the positions of the keys and transmit signals representative of key position, velocity and pressure.

2. Background Art

The prior art includes many electronic musical instruments which are played by striking keys. These instruments are arranged to simulate conventional keyed instruments, such as pianos and organs, or to create musical sounds which cannot be produced by conventional keyed instruments.

With the advent of microprocessors, many musical effects, not otherwise producible by conventional musical instruments, can be created by electronic musical instruments. For example, a key of an electronic musical instrument can be manipulated in more ways to produce a greater variety of effects than a key of a conventional piano or organ. Also, it is possible to simulate instruments, such as violins and cellos, with a keyed electronic musical instrument.

Among the factors which contribute to the overall musical effect produced by a keyed electronic musical instrument are the touch of the musician, the velocity and force with which the keys are struck, the duration that the keys are depressed, and the after-touch or key pressure. Consequently, the components which sense the way in which the keys are manipulated and the circuitry which processes the signals developed by the sensor components are all-important in the design of such instruments.

Generally, electronic musical instruments having keyboards use mechanical switches or other contacting devices to sense the striking of the keys. In its simplest form, the depression of a key is sensed by the opening or closing of the sensor. More sophisticated versions of such instruments are able to sense the velocity at which the keys are struck and the after-touch or key pressure.

Mechanical sensing of key manipulation has a number of shortcomings. The musician can feel the connection and disconnection of mechanical sensors as the keys are being struck and this can be bothersome. Such an effect is not produced when the keys of a conventional piano or organ are struck.

As a practical matter, mechanical sensors also limit the versatility and flexibility of electronic musical instruments, particularly if cost of manufacture is a consideration. The mechanical components and the processing circuitry tends to be complex and, therefore, expensive as more of the features contributing to the desired musical effect are incorporated into the instrument.

Mechanical sensing also suffers from the inherent shortcoming of wear and tear. The making and breaking of contacts eventually leads to the need to repair the instruments and to replace parts.

DISCLOSURE OF THE INVENTION

Accordingly, it is an objective of the present invention to provide a new and improved electronic musical keyboard.

It is another objective of the present invention to provide an electronic musical keyboard which permits the musician to achieve a wide variety of musical effects.

It is a further objective of the present invention to provide an electronic musical keyboard which uses non-contacting inductance coil sensors and, therefore, is not subject to the wear and tear of mechanical sensors.

It is yet another objective of the present invention to provide an electronic musical keyboard which is reliable in operation, relatively simple in construction, and relatively inexpensive to fabricate.

These and other objectives are achieved, in accordance with the present invention, by a musical keyboard having a plurality of movable keys positioned side-by-side and an inductance coil sensor system for sensing the position of each of the keys. The inductance coil sensor system has a plurality of sensor tank circuits. Each sensor tank circuit has a sensor inductance coil associated with one of the keys and positioned in the path of movement of its associated key. Each key carries a metal spoiler which moves toward and away from its associated sensor inductance coil to change the resonance frequency of its associated sensor tank circuit, the amplitude of the resonance peak of its associated sensor tank circuit, and the phase about the resonance peak of the associated sensor tank circuit.

The musical keyboard of the present invention further includes first circuit means responsive to a selected one of the changing characteristics of the sensor tank circuits for developing indications of the positions of the keys. Means are included for supplying to the first circuit means a reference signal in a domain corresponding to the selected changing characteristic from which the position indications are developed. The reference signal represents a predetermined value against which the position indications are referenced. Also included in the present invention are second circuit means for sequentially connecting the reference tank circuit and the sensor tank circuits to the first circuit means.

In a preferred embodiment of the present invention, a single capacitor is switched sequentially between the inductance coil in the reference tank circuit and the sensor inductance coils of the sensor tank circuits. In this way, a single capacitor serves the purpose of a plurality of capacitors and there is no need to provide a plurality of matched capacitors.

BRIEF DESCRIPTION OF THE DRAWINGS

Referring to the drawings.

BEST MODE OF CARYING OUT THE INVENTION

Figure 1:
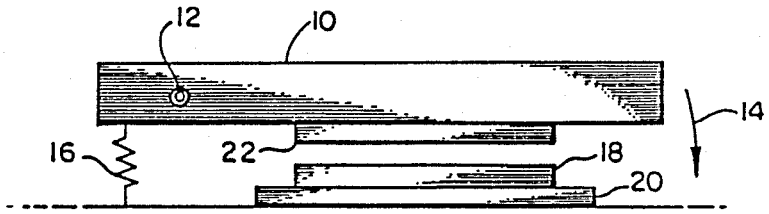
FIG. 1 is a schematic diagram of a musical key assembly which can be used in the present invention.

Referring to FIG. 1, a musical key assembly which can be used in the present invention has a key 10 which is mounted to pivot about an axis 12. As key 10 is depressed and moves in the direction of arrow 14, the key moves against a restoring spring 16 which returns the key to its rest position when the force moving the key is removed. A suitable damping component, which is not shown, would be included in the key assembly to prevent key 10 from oscillating under the influence of restoring spring 16 after the force depressing the key is removed.

The key assembly also includes a sensor inductance coil 18 positioned in the path of pivotal movement of key 10. Sensor inductance coil 18 can be formed in a number of ways and can have various configurations. A preferred way of forming sensor inductance coil 18 is by conventional printed circuit techniques and FIG. 1A shows a preferred planar winding configuration of the sensor inductance coil mounted on an insulating board 20.

The key assembly further includes a metal spoiler 22 mounted on the underside of key 10 and movable with the key toward and away from sensor inductance coil 18 to vary the inductance of the sensor inductance coil in accordance with the position of the key relative to the sensor inductance coil. Metal spoiler 22 can be a coil, similar to sensor inductance coil 18, or a solid, planar part.

Figure 1A:
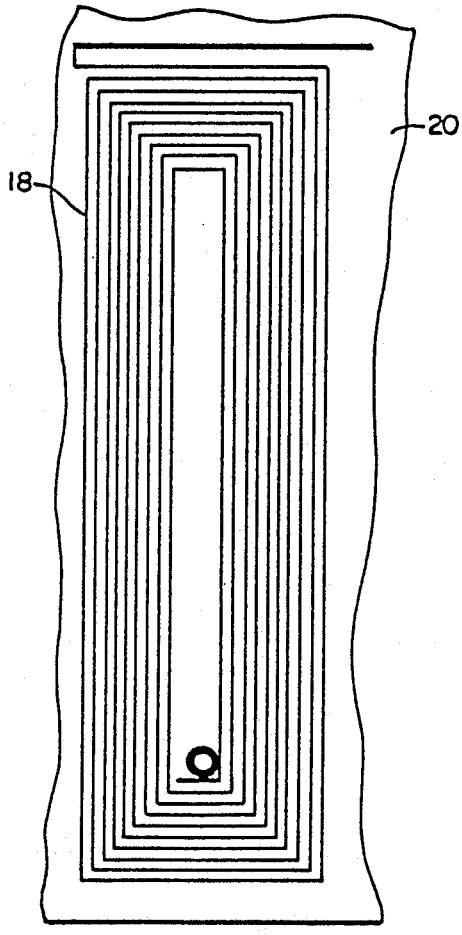
FIG. 1A is a plan view, on an enlarged scale, of a sensor inductance coil which can be used in the present invention.
Figure 2:
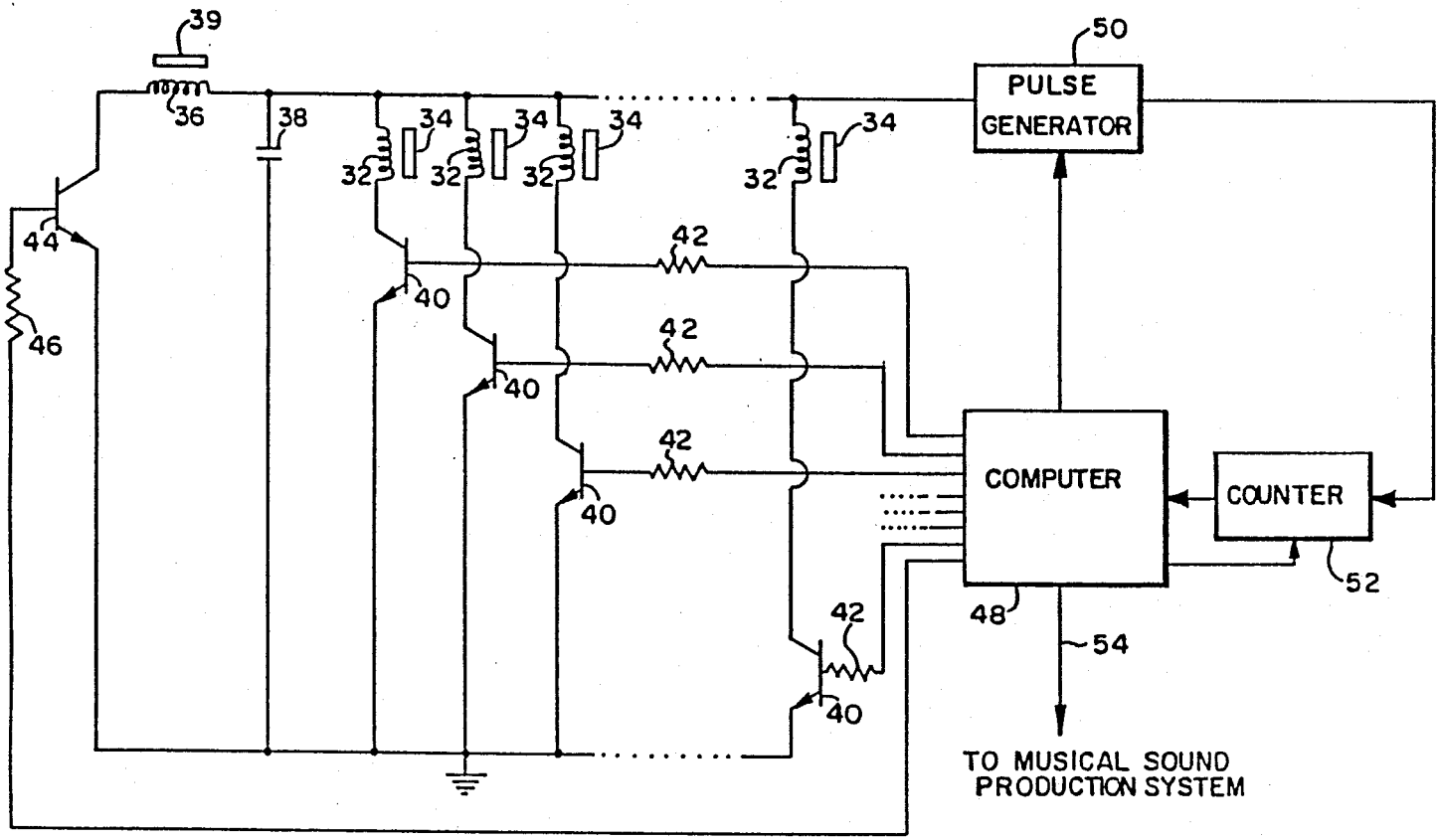
FIG. 2 is a circuit diagram of a preferred embodiment of a musical keyboard constructed in accordance with the present invention.

A musical keyboard, constructed in accordance with the present invention, includes a plurality of key assemblies, such as the one shown in FIGS. 1 and 1A, positioned side-by-side. This is represented in FIG. 2 by a plurality of sensor inductance coils 32 and a plurality of metal spoilers 34. Only four key assemblies are represented in FIG. 2. However, a large number, such as sixteen or forty-eight, would be included in a commercial version of the present invention.

Also included in the circuit of FIG. 2 are a reference inductance coil 36 and a capacitor 38 which form a reference tank circuit. Sensor inductance coils 32 and capacitor 38 form a plurality of sensor tank circuits. The position of each spoiler 34, relative to its associated sensor inductance coil 32, determined the resonance frequency of its associated sensor tank circuit, the amplitude of the resonance peak of its associated sensor tank circuit, and the phase about the resonance peak of the associated sensor tank circuit. The reference tank circuit supplies a reference signal representative of a predetermined value of a selected parameter such as a predetermined nominal position of spoilers 34. For the embodiment of the invention being described, the resonance frequency of each sensor tank circuit is the selected changing characteristic which is measured to indicate the positions of the keys. By using a tank circuit to supply the reference signal, the domain of the reference signal may be selected to correspond to the domain of the selected changing characteristic of the sensor tank circuits. Accordingly, the reference tank circuit supplies a reference signal having a resonance frequency dependent upon the value of capacitor 38 and the value of reference inductance coil 36 as established by the position of a reference spoiler 39.

The reference tank circuit and the sensor tank circuits are formed by sequentially connecting reference inductance coil 36 and sensor inductance coils 32 across capacitor 38. This is accomplished by switching means which include a plurality of transistors 40, one connected in series with each sensor inductance coil 32; a plurality resistors 42, one associated with each transistor 40; a transistor 44 connected in series with reference inductance coil 36; a resistor 46 associated with transistor 44; and a computer 48.

Computer 48 controls the on/off operation of transistor 44 and transistors 40 to sequentially connect the reference tank circuit and the sensor tank circuits to frequency sensing means composed of a pulse generator 50 and a counter 52. In particular, reference inductance coil 36 and sensor inductance coils 32 are switched sequentially to the input of pulse generator 50 according to the sequential activation of transistor 44 and transistors 40 by computer 48. Capacitor 38 is permanently connected to the input of pulse generator 50.

Figure 3:
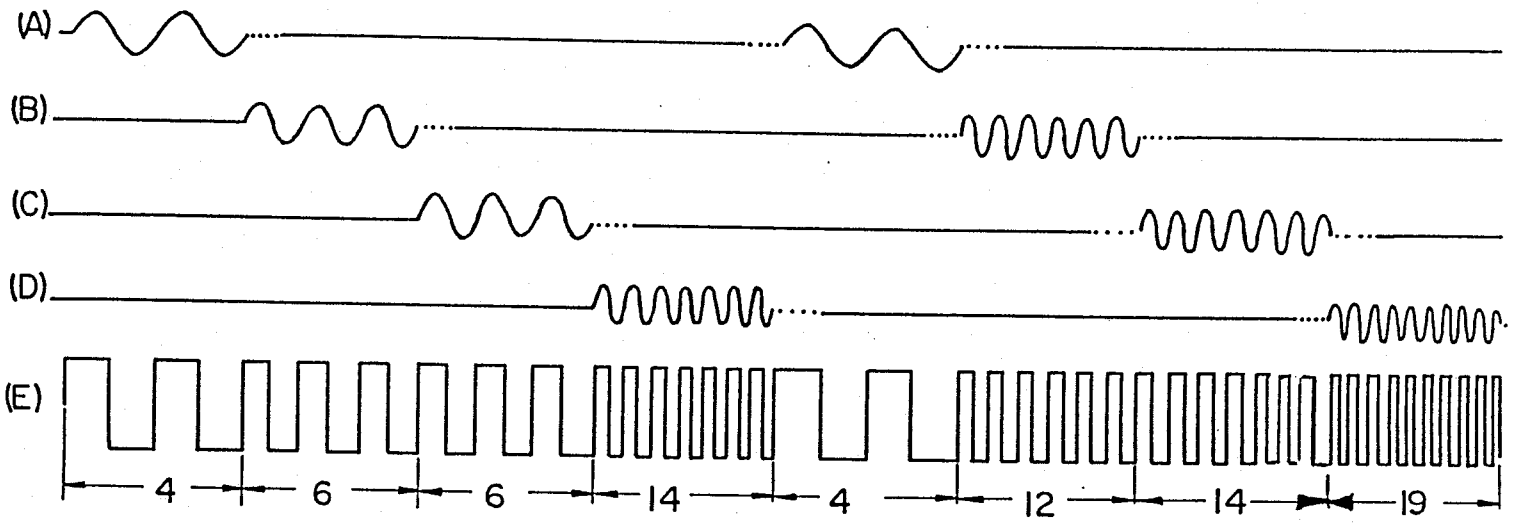
FIG. 3 is a series of waveform diagrams useful in understanding the operation of the FIG. 2 circuit.

The resonance frequency of the reference tank circuit is set by adjusting the position of reference spoiler 39 relative to the position of reference inductance coil 36. The positions of metal spoilers 34, relative to the positions of their associated sensor inductance coils 32, establish the resonance frequencies of the sensor tank circuits. Waveform (A) of FIG. 3 represents the resonance frequency of the reference tank circuit. Waveforms (B), (C) and (D) of FIG. 3 represent the resonance frequencies of three sensor tank circuits. The first series of oscillations of waveforms (B) and (C), having the same frequency, indicate that the associated keys have been depressed to the same degree, while the first series of oscillations of waveform (D), having a higher frequency, indicates a different degree of depression of the associated key. The second series of oscillations of waveforms (B), (C) and (D) indicate that the associated keys have moved during the time period between the first series of oscillations and the second series of oscillations of each waveform.

At any particular time, the reference tank circuit or one of the sensor tank circuits is connected to the input of pulse generator 50. The repetition rate of the output of pulse generator 50 corresponds to the resonant frequency of the particular tank circuit connected to the pulse generator at that time. Waveform (E) of FIG. 3 represents the output of pulse generator 50 and shows groups of pulses having repetition rates corresponding to the resonance frequency of the particular tank circuit connected to the input of the pulse generator. During those periods when reference inductance coil 36 is connected to pulse generator 50, the repetition rate of the output of the pulse generator corresponds to the resonance frequency of the reference tank circuit. During those periods when one of the sensor inductance coils is connected to pulse generator 50, the repetition rate of the output of the pulse generator corresponds to the resonance frequency of the particular sensor tank circuit connected to the pulse generator.

The output of pulse generator 50 is supplied to counter 52 which counts the number of pulses which it receives during known periods of time. Computer 48 turns pulse generator 50 on and off to establish the known periods of time during which counter 52 counts pulses supplied by the pulse generator. The pulse count during any such known period of time is dependent upon the rate at which the pulses are supplied from pulse generator 50 which, in turn, is dependent upon the resonance frequency of the particular tank circuit connected to the pulse generator. Thus, the pulse count developed by counter 52 represents the position of the key associated with the tank circuit which produced the pulses. The numbers beneath waveform (E) of FIG. 3 represent the number of positive-going and negative-going pulses counted during the indicated time periods. By referencing the pulse counts produced by the sensor tank circuits against the pulse count produced by the reference tank circuit, the pulse counts produced by the sensor tank circuits provide accurate indications of the positions of spoilers 34 relative to their associated sensor inductance coils 32 and, therefore, the movements of the associated keys.

Counter 52 is reset by computer 48 at the end of each time period during which pulses are counted. It should be understood that in actual operation of the FIG. 2 circuit, there are very brief periods of time between the groups of pulses produced by pulse generator 50 to permit resetting of counter 52 after each fixed period during which pulses are counted. As a result, wave form (E) actually would have brief time periods between the groups of pulses during which no pulses are present.

Computer 48, in response to the count developed by counter 52, controls a musical sound production system according to which keys have been depressed and the manner in which the keys have been depressed. The musical sound production system is not a part of the present invention.

Referring now to Pseudo Code Listing 1, there is shown an overview of the computer-implemented process of the present invention. General-purpose computer 48, which is connected to the plurality of tank circuits as previously described, and is connected to a serial data port 54 capable of transmitting signals conforming to the Musical Instrument Digital Interface (MIDI) specification, performs the depicted steps repetitively to provide a substantially continuous data flow to serial port 54. *MIDI Specification* 1.0, published by the International MIDI Association is incorporated herein by reference. The functions of the computer-implemented process include the sequential addressing of each of the tank circuits associated with keys 10 on the keyboard, enablement of the counter circuit 52 to determine the position of each key 10, storage of the key position, comparison of the newly determined key position with the last stored key position available, formatting of a serial data stream indicative of key position and other information (in MIDI format), and transmission of the digital serial data to remote devices such as sequencers, recorders, and musical synthesizers (not shown).

Because aftertouch and velocity are two subtle factors in the tonal characteristics of keyboard instruments, the keyboard of the present invention provides a mechanism for determination of this information. Specifically, key positions are sampled rapidly (for example, at a rate of 10,000 keys/second) and key positions are stored in a "key state record" for comparison with subsequent position information. By comparison of two positions separated by the known length of time (at a minimum, that required to scan all other keys on the keyboard,) key velocity (speed and direction) can be determined. Similarly, by establishing an arbitrary "fully depressed" position, any degree of aftertouch sensitivity can be permitted. In normal operation, the fully depressed position will correspond to the point at which the key travel is physically limited (by, for example, an elastomeric stop (not shown)). Compression of the stop will permit limited key travel past this point and be encoded as aftertouch.

Referring to Listing 1, there is shown a PseudoCode representation of the process steps performed by computer 48 of the present invention. Initialization processing includes resetting of the system hardware, such as input/output ports, counters, and enablement of system interrupts. Further initialization sets up threshold values for the "key up" position, the "key down" position, and the "pressure point", beyond which aftertouch will be endoded. Data structures such as the MIDI Queue, and the LastTime array are initialized with zero values and base positions. Before beginning to scan the key array, the oscillator tank circuits are "quenched" to reset them, and the counters are reset to zero.

Finally, the period used to count pulses from the sensor oscillator tank circuits is normalized with respect to the reference oscillator tank circuit. A timer is used to determine the period required for the reference oscillator tank circuit to produce a predetermined number of pulses. This period is then used for the subsequent scan of the key array. The period is renormalized after each scan, thereby allowing a close approximation of the best resolution of the system:

$$\text{Period} = \frac{N}{f_{ref}}$$

Where:

N is the desired count $f_{ref}$ is the frequency of the reference oscillator tank circuit Period is the time used to measure the pulses produced by a given key sensor oscillator tank circuit The scan of the key array comprising the keyboard is dependent on an index which assumes the value of each ordinal key location in the array. For each key, the associated tank circuit is enabled, and counter 52 allowed to accumulate pulses for a known time period. After this time, the total counts are read and scaled to a non-linear key position range. This position is then saved for further processing.

Based upon the current position of the key being addressed and its position on the last scan of the keyboard, there are several possible events which can occur. These events may be summarized as a list of possible key state transitions:

| Last | New | MIDI Event* |
|---|---|---|
| InActive | InActive | None |
| InActive | Active | NoteOn (Velocity) |
| Active | Active | None (AfterTouch) |
| Active | InActive | NoteOff (Velocity) |

*Note:
MIDI Events are fully described in the MIDI Specification 1.0 (International MIDI Association, 1983) which is incorporated herein by reference.

Of course, various indications (e.g. absolute position, velocity, pressure) may be derived from the keyboard of the present invention and these may be applied to parameters beyond those specified by the MIDI standard as well as the MIDI messages detailed in *The MIDI Specification.*

Because of timing constraints and differences in data rates between keyboard scanning operations and transmission of MIDI data over the serial port, MIDI messages are enqueued to a preallocated MIDI queue, and are transmitted on an interrupt-driven basis.

Finally, the index is incremented (with tests for out-of-range conditions) and the next key is processed.

The foregoing has set forth an exemplary and preferred embodiment of the present invention. It will be understood, however, that various alternatives will occur to those of ordinary skill in the art without departure from the spirit and scope of the present invention.

Listing 1 - PseudoCode for Computer-Implemented Process Steps

```
Program KeyScan

Initialize: Hardware Functions, Keyboard Threshold Values,
            MIDI Queue, LastTime [ ] for Key State Records, N
Quench Oscillators
Reset Counters
Enable Oscillators
Start Interval Timer
While
    Pulses < N
EndWhile
Stop Interval Timer
t Period := Interval Timer Reading
LABEL : Count
Address Key
Count Pulses for t Period
Quench Oscillators
Read & Translate New_KeyPosition
Save KeyPosition
IF KeyPosition from LastTime [ ] was INACTIVE          THEN
    IF New_KeyPosition is INACTIVE                     THEN
        Save New_KeyPosition in LastTime [ ]
    ELSE  (Key is now active)
        IF KeyRecord is Available in MIDI Queue        THEN
            ALLOCATE KeyRecord in MIDI Queue
        ELSE  (Must steal a record!)
            ALLOCATE OLDEST KeyRecord in MIDI Queue
            Mark Key as Preempted
        EndIF  (InActive -> Active)
    EnQueue a MIDI Note_ON Event
    EndIF  (InActive -> InActive)
ELSE  (Key was active, what is it now?)
    IF Key is Preempted                                THEN
        IF New_KeyPosition is ACTIVE                   THEN
            Do Nothing!
        ELSE  (Key has now gone inactive)
            EnQueue a MIDI NOTE_OFF Event
        EndIF  (Preempted key processing)
    ELSE  (Key has a record)
        IF Key is InActive                             THEN
            EnQueue a MIDI Note_OFF Event
            DeActivate KeyRecord in MIDI Queue
```

```
            ELSE (Key Active -> Active)
                UpDate KeyRecord in MIDI Queue
            EndIF
        EndIF
    EndIF
    IF KeyPosition is in AfterTouch Range                    THEN
        Enqueue MIDI Note_ON (with AfterTouch)
    EndIf
    KeyIndex := KeyIndex + 1
    IF KeyIndex > TopKeyNumber
        THEN
        KeyIndex := KeyIndex - TopKeyNumber
        Start Interval Timer
        While
            Pulses < N
        EndWhile
        Stop Interval Timer
        1 Period := Interval Timer Reading
    EndIF
    GOTO Count.
```

Non-Printed Appendix 1 to

MUSICAL KEYBOARD

David Fiori, Jr.

```
*************************** PROCESS ***************************

DEBUG    equ     0      ; Assemble debug version?
RAW      equ     0      ; Save raw, untranslated key coordinates?
SINGLE   equ     0      ; Test version for a single sensor board?

         public  COUNT

$include.a65            ; Include constants and miscellaneous stuff.
$extern.a65             ; Include external declarations for storage.
$ifstruct.a65           ; Include if-structures.
$linkmacr.a65           ; Include macros for linking and unlinking.

;        External declarations for tables.

         extern  keysel,quencn,xlate,linear,vtrans

;        External declarations for subroutine entries.

         extern CBYTE,QSTAT

;        Constants.

SCOPEbit equ    040h    ; This bit synchs the oscilloscope.
NoteOn   equ     90h    ; Midi status byte code.
NoteOff  equ     80h    ; Midi status byte code.
PolyPr   equ    0A0h    ; Polyphonic pressure status byte.
```

```
;       COUNT: reads all keys and processes the information for MIDI.

        rseg code

COUNT: ldy #BankSize-1 ; Set up index into each bank of keys

       smb 6,KYSPORT   ; Arrange for a
       nop             ; scope synch
       nop             ; pulse
       nop             ; of
       nop             ; reasonable
       rmb 6,KYSPORT   ; width.

;  Read in the previously accumulated count for each bank, and translate
;  to the nonlinear position range 0..127 (getting rid of counter wrap).

kloop:
       ldx COUNT0      ; Get count for bank 0 (left end of keyboard)
       lda xlate, x    ; Translate to range 0..127.
       sta new0        ; Save answer.

       ldx COUNT1
       lda xlate,x
       sta new1

       ldx COUNT2
if RAW
       txa             ; Save the UNTRANSLATED value in new2.
else
       lda xlate,x     ; Save the translated valuse in new2.
endif
sta new2

ldx COUNT3
lda xlate,x
sta new3

;      Quench the oscillators to get them ready for synchronous turn-on.

       lda #quench     ; Quench oscillators.
       sta KYSPORT
       sta CRESET      ; Reset all the key-position counters.

       lda #0          ; Turn off
       sta TGATE       ; timers.

;      Set up the count times for the next count cycle for each oscillator.

       lda delay0      ; Set up the delay time
       sta TIME0       ; for counter 0.
       lda delay1      ; Etc.
       sta TIME1       ;
       lda delay2      ;
       sta TIME2       ;
       lda delay3      ;
       sta TIME3       ;

;      Start the timers and the oscillators and begin the count cycle.

       sei             ;;; This should be done with known timing.
       lda #1          ;;; Start the
       sta TGATE       ;;; timers.

       lda keysel,y    ;;; Reset off, quench off,
                       ;;; key select = next key.
       sta KYSPORT     ;;; Begin counting.
       cli
```

```
; Process a key for MIDI transitions.

; The PROCESS rountine gets the new position for a key, and can also
; consult the LastTime array for that key.  If the LastTime value
; represents a position the key must have been inactive on the last
; look.  If it is an index, the key is attached to a state record, and
; must have been active at the previous time step.

; If the key was active before, and was in the DOWN state (as judged by
; examination of the state record) and now is above the TopTh position,
; a KEY UP message must be issued.  If it is now in the inactive region,
; the state record can be detached.

; If the key was inactive before, and now is found in the active range,
; a state record must be attached to it if possible.

; If the key is now in the active range, appropriate MIDI output must be
; generated.

        MACRO &doMIDI

        lda LastTime\0,y  ; Get the previous position or index.
                          ; Bit 7 distinguished position from index.
&if c_code,pl,true

        ; LastTime contains a position (bit 7 low), meaning that
        ; the key was inactive on the last look.

        lda new\0         ; Get key's new position.
        cmp VeryTopSw     ; Is the key in the active region now?
if DEBUG
  sec   ; force hs condition true so that key positio
        ; always gets saved and never gets acted upon.
endif
        &if c_code,ns,true
            ; It was inactive before and is still inactive.

            sta LastTime\0,y   ; Save the current position as latest.
            jmp end_midi\0     ; This is the minimum-time path.
                               ; Simplify things with a goto (to loop end).
        &endif

        ; The key was inactive before but it's active now.
        ; We have to allocate a new record of active-key information.

        lda FwdLink+FreeAnchor ; Is there
        cmp #FreeAnchor        ; a free record?
        &if c_code,eq,true

          ; No free record is available.  Steal the oldest record from
          ; the work list and mark its old key with the PREEMPTED flag,
          ; which can only be removed when the old key becomes inactive.

         ldx FwdLink+WorkAnchor; Get record index from tail of work list.
         stx record_index       ; Save index for later use.
         lda KeyNum,x           ; Get the key number which owns the record now
         tax                    ; Mark the key as PREEMPTED, which means it
         lda #PREEMPTED         ; is disabled and can't steal the record back.
         sta LastTime0,x        ; Note use of x register!
         &unlink record_index   ; Detach the stolen record from the work list.

        &else

          ; A free record is available.  Unlink it from the free list.

         ldx FwdLink+FreeAnchor ; Get record index from free list.
         stx record_index       ; Save index for later use.
         &unlink record_index   ; Detach the free record from its list.
```

```
&endif

;       Add the new record to the work list and initialize the record to
;       reflect the new key's previous inactivity.

&link record_index,WorkAnchor
                            ; Add the record to the head of the work list
ldx record_index            ; Get the record number.

tyx                         ; Put the
ora #\0*16                  ; full key number
sta KeyNum,x                ; into the new record.

lda #0                      ; Set up the initial
sta AftAvgL,x               ; aftertouch average
sta AftAvgH,x               ; starting at zero
sta LastAftOut,x            ; Last (i.e., previous) aftertouch byte out.

lda LastTime\0,y            ; Get prior position.
ora #80h                    ; Key has to be in UP state (inactive before).
sta OldPos,x                ; Save as previous position.
lda VeryTopSw               ; Save presumed top position
ora #80h                    ; with Up-ness
sta OldOldPos,x             ; as previous previous position.

txa                         ; Save the new record-index,
ora #80h                    ; flagged as an index,
sta LastTime\0,y            ;as the index/position byte for this key.

&else                       ; End of (LastTime = position) code.

; The key was active before and should have a record.

cmp #PREEMPTED              ;Has the key had its record stolen?
&if c_code,eq,true

    ; The key is active but has had its record stolen by a later
    ; keypress.  It must be ignored until it's become inactive again
    ; (that is, until it's all the way up).

    lda new\0               ; Is the key still down
    cmp VeryTopSw           ; in the active region?
    &if c_code,hs,true

        ; The key was preempted and has now become inactive.
        ; Queue a Note Off event and remove the preempted flag.

        lda #NoteOn         ; Status = note on, channel 0.
        jsr QSTAT           ; Queue the status byte.
        tya                 ; Get note number.
        clc
        adc #Basekey\0      ; Reference to lowest key position
        jsr QBYTE           ; Queue the key number.
        lda #0              ; Velocity zero.
        jsr QBYTE           ; Send as final byte of MIDI Note On sequence.

        lda new\0           ; Save current position
        sta LastTime\0,y; instead of PREEMPTED flag.

    &endif

jmp end_midi\0

&else

    ;   The key has not been preempted and possesses an active record
```

```
        and #7Fh            ; Remove the flag bit 7
        tax                 ; from the record index
        stx record_index    ; Save a copy for later.

    &endif

&endif
    ; The key has an active, initialized record.
    ; Perform standard MIDI processing, using information in the record.

    lda new\0               ; Get current position
    cmp TopSw               ; Is key up?
    &if c_code,hs,true

        ; Key is up.

        lda OldPos,x            ; Was the key up last time,too?
        &if c_code,pl,true

            ; Key was not up before.
            ; Queue a Note Off event.

            lda #NoteOn         ; Status = NOTE ON, channel 0 (yes,ON).
            jsr QSTAT           ; Queue the status byte.
            tya                 ; Get note number.
            clc
            adc #BaseKey\0      ; Reference to lowest key position.
            jsr QBYTE           ; Queue the key number.
            lda #0              ; Velocity ZERO (to turn off note).
            jsr QBYTE           ; Send as final byte of MIDI Note on sequence.

        &endif

        lda new\0               ; Is the new key position
        cmp VeryTopSw           ; up in the inactive region?
        &if c_code,lo,true

            ; Key is still active.

            ldx record_index        ; Update
            lda OldPos,x            ; the
            sta OldOldPos,x         ; record
            lda new\0               ; with
            ora #UP                 ; the latest
            sta OldPos,x            ; information
            jmp end_midi\0

        &else

            ; The key was active and has just become inactive.
            ; Free its record and put LastTime entry back to normal.

inactive\0:                             ; Label for debugging.
            &unlink record_index        ; Detach record from work list
            &link record_index,FreeAnchor ; and add it to the free list.

            lda new\0                   ; Save current position
            sta LastTime\0,y            ; instead of index.

            jmp end_midi\0

        &endif

    &endif

    cmp BotSw               ; Is key down?
```

```
&if c_code,hs,true

    ; Key is neither up nor down, but in between.

    lda OldPos,x        ; The old position
    sta OldOldPos,x     ; becomes the oldest now.
    and #80h            ; Capture old state bit.
    ora new\0           ; Insert into new position,
    sta OldPos,x        ; and save as old position.
    jmp end_midi\0      ; Exit to end simplifies structure.

&endif

; Key is down.

lda OldPos,x            ; Was key already down?
&if c_code,mi,true

    ; Key was not down before.
    ; Queue a Note On event.

    lda #NoteOn         ; Status = Note on, channel 0.
    jsr QSTAT
    tya                 ; Get note number.
    clc
    adc #BaseKey\0      ; Reference to lowest key position.
    jsr QBYTE

    ldx record_index    ; From the record,
    lda OldOldPos,x     ; get oldest position.
    and #7Fh            ; Mask off the old state bit.
    tax                 ; Look up
    lda linear,x        ; linearized old position.
    ldx new\0           ; Get the new position.
    sec                 ; Subtract linearized new position
    sbc linear,x        ; from linearized old position.
    tax                 ; Translate to
    lda vtrans,x        ; MIDI-style velocity.
    jsr QBYTE           ; Send as final byte of MIDI Note on sequence.

&endif

; If modulation is in effect, and it's this key's turn on
; the phase wheel, and the key is below the pressure/aftertouch
; threshold, send a key pressure (polyphonic aftertouch) message.

Touch\0:                ; This label is for debugging!

lda ModSw               ; Modulation in effect?
&if c_code,ne,true

    ; Modulation is in effect.
    ; Is it time to do it for this key?

    tya                 ; Get our key number.
    eor phCount         ; Compare with phase count.
    and #03h            ; Save the last 2 bits (every fourth time).
    &if c_code,eq,true

    ; It's this key's turn "on the phase wheel" to send aftertouch.
    ; Is the key pressed down enought to qualify as an aftertouch?

        lda new\0           ; Is the key
        cmp PressSw         ; getting p-u-s-h-e-d on?
        &if c_code,lo,true
```

```
; Key is being pushed down into the pressure region.
; Calculate the new aftertouch average.

; method (thanks to Bill Mauchly):

; New Average = (Old Average * 3/4) + (new value)
; Current Output = (New Average) / 4

ldx record_index
clc                         ; Multiply
lda AftAvgL,x               ; old
rol a                       ; average
sta temp1                   ; by
lda AftAvgh,x               ; two
rol a                       ; and
sta temp2                   ; save.

lda temp1                   ; Get back doubled AftAvgL.
clc                         ; Add
adc AftAvgL,x               ; in
sta temp1                   ; one
lda temp2                   ; more
adc AftAvgH,x               ; old average,
sta temp2                   ; so it's times three altogether.

clc                         ; Divide
ror temp2                   ; the
ror temp1                   ; thing
clc                         ; by
ror temp2                   ; four.
ror temp1                   ; Now it's (old avg) * 3/4

lda PressSw                 ; Calculate how far
sec                         ; key is below
sbc new\0                   ;  pressure threshold.

clc                         ; Add in
adc temp1                   ; the average * 3/4
sta AftAvgL,x               ; as computed above.
sta temp1
lda temp2                   ; This becomes
adc #0                      ; the new
sta AftAvgH,x               ; average.

clc                         ; Finally
ror a                       ; divide the
ror temp1                   ; new average
ror a                       ; by four
ror temp1                   ; to get the current aftertouch byte.

; Is the current byte any different than the last one sent?
; If so, send it out in a MIDI message.

lda temp1                   ; Get new output.
cmp LastAftOut,x            ; no point sending it twice.
&if c_code,ne,true

    ; Send a Polyphonic Key Pressure message.

    sta LastAftOut,x        ; Save for comparison next time.

    lda #polyPr             ; Status = poly pressure, channel 0.
    jsr QSTAT               ; Queue the status byte.

    tya                     ; Get key number within the bank.
    clc                     ; Calculate MIDI note number using
```

```
                acc #BaseKey\0        ; the base key number for this bank.
                jsr QBYTE             ; Queue the note number

                ldx temp1             ; Get the current aftertouch byte.
                lda presstab,x        ; Translate to pressure (0..127).

            jsr QBYTE                 ; Queue the pressure value.

          &endif

        &endif

      &endif

    &endif

    ; Update the record and stash the new position.

    ldx record_index        ; Point to this key's active record.
    lda OldPos,x            ; The old value
    sta OldOldPos,x         ; now becomes the oldest.
    lda new\0               ; The new position
    sta OldPos,x            ; now becomes the old.

end_midi\0:

  if SINGLE
    ldx #24 ; waste (about 24 * 5 / 2 = 60 usec)
label\0     ; some
    dex     ; time.
    bne label\0
  endif

      ENDMAC

        ; now invoke the big macro we just defined.

    if 1-SINGLE
midi0    &doMIDI 0                  ; Do MIDI for the key from bank 0.
midi1    &doMIDI 1                  ; Ditto bank 1.
midi2    &doMIDI 2                  ; Ditto.
midi3    &doMIDI 3                  ; Itto.
  endif

  if SINGLE
midi2    &doMIDI 2                  ; Just do a single board for testing.
  endif
        ; Go on to the next key in each bank.

        dey

        &if c_code,pl,true
            jmp kloop               ; Loop if there's still work.
        &endif

        rts                         ; End of COUNT routine.

;       The following really belongs in TABLES, I guess.

presstab
        db      0,10,20,30,40,50,60,70,80,90,100,110,120,127,127
        db      127,127,127,127,127,127,127,127,127,127,127,127
        db      127,127,127,127,127,127,127,127,127,127,127,127
        db      127,127,127,127,127,127,127,127,127,127,127,127

        end
```

What is claimed:

1. A musical keyboard comprising:

a plurality of movable keys positioned side-by-side;

an inductance coil sensor system having (a) a plurality of sensor tank circuits each having a sensor inductance coil associated with one of said keys and positioned in the path of movement of its associated key, and (b) a plurality of metal spoiler means, one mounted on each of said keys, for changing the resonance frequencies of said sensor tank circuits, the amplitudes of the resonance peaks of said sensor tank circuits, and the phases about the resonance peaks of said sensor tank circuits in response to movements of said metal spoiler means toward and away from said sensor inductance coils;

first circuit means responsive to a selected one of said changing characteristics comprising resonance frequencies of said sensor tank circuits, amplitudes of the resonance peaks of said sensor tank circuits, and phases about the resonance peaks of said sensor tank circuits for developing indications of positions of said keys;

means for supplying to said first circuit means a reference signal in a domain corresponding to said selected changing characteristic and representative of a predetermined value against which said position indications are referenced;

and second circuit means responsive to said first circuit means for sequentially connecting said sensor tank circuits to said first circuit means.

2. A musical keyboard according to claim 1 wherein said first circuit means include frequency sensing means for developing indications of the resonance frequencies of said sensor tank circuits.

3. A musical keyboard according to claim 2 wherein said frequency sensing means include:

(a) a pulse generator to which said sensor tank circuits are sequentially connected for developing groups of pulses, each group having a repetition rate corresponding to the resonance frequency of the tank circuit connected to said pulse generator; and (b) a counter for counting pulses developed by said pulse generator during known periods of time.

4. A musical keyboard according to claim 3 wherein said second circuit means:

(a) control said pulse generator to supply pulses to said counter during known periods of time; and (b) reset said counter at the end of each of said known periods of time.

5. A musical keyboard according to claim 4 wherein said keys are pivotally mounted.

6. A musical keyboard according to claim 5 wherein said reference signal means include a reference tank circuit having a reference inductance coil.

7. A musical keyboard according to claim 6 wherein said second circuit means sequentially connect said reference tank circuit and said sensor tank circuits to said pulse generator.

8. A musical keyboard according to claim 6 wherein said reference tank circuit and said sensor tank circuits have a common capacitor connected to said pulse generator and said secong circuit means sequentially connect said reference inductance coil and said sensor inductance coils to said capacitor to form said reference tank circuit and said sensor tank circuits, respectively.

9. A musical keyboard according to claim 8 wherein said second circuit means include:

(a) a plurality of switching elements, one connected in series with said reference inductance coil and each of said sensor inductance coils; and (b) a computer for:

(i) establishing said known periods of time, (ii) resetting said counter, and (iii) controlling said switching elements to connect said reference inductance coil and said sensor inductance coils to said pulse generator.

10. A musical keyboard according to claim 9 wherein said computer establishes said known period of time by normalization of said time period based on the resonance frequency of said reference tank circuit.

11. A musical keyboard comprising:

a plurality of movable keys positioned side-by-side;

a plurality of sensor inductance coils, one associated with each of said keys, positioned side-by-side and in the paths of movement of their associated keys;

a plurality of metal spoiler means, one mounted on each of said keys, movable with said keys toward and away from said sensor inductance coils for varying the inductances of said sensor inductance coils;

a capacitor;

switching means for sequentially connecting said sensor inductance coils across said capacitor to sequentially form a plurality of sensor tank circuits, said sensor tank circuits having resonance characteristics dependent upon the relative positions of said sensor inductance coils to their associated spoilers;

means for supplying a reference signal;

and circuit means coupled to said reference signal means and said plurality of sensor tank circuits for sensing changes in the resonance characteristics of said plurality of sensor tank circuits relative to said reference signal to develop indications of the positions of said keys.

12. A musical keyboard according to claim 11 wherein said sensor inductance coils are planar windings mounted on an insulating board.

13. A musical keyboard according to claim 11 wherein said circuit means include frequency sensing means for developing indications of the resonance frequencies of said sensor tank circuits.

14. A musical keyboard according to claim 13 wherein said freuency sensing means include:

(a) a pulse generator to which said sensor tank circuits are sequentially connected to developing groups of pulses, each group having a repetition rate corresponding to the resonance frequency of the tank circuit connected to said pulse generator; and (b) a counter for counting pulses developed by said pulse generator during known periods of time.

15. A musical keyboard according to claim 14 wherein said switching means:

(a) a control said pulse generator to supply pulses to said counter during known periods of time; and (b) reset said counter at the end of each of said known periods of time.

16. A musical keyboard according to claim 15 wherein said reference signal means include a reference inductance coil and said switching means sequentially connect said reference inductance coil and said sensor inductance coils across said capacitor to sequentially form a reference tank circuit and said plurality of sensor tank circuits.

17. A musical keyboard according to claim 16 wherein said switching means include:

(a) a plurality of switching elements, one connected in series with said reference inductance coil and each of said sensor inductance coils; and (b) a computer for:

(i) establishing said known periods of time, (ii) resetting said counter, and (iii) controlling said switching elements to connect said reference inductance coil and said sensor inductance coils to said pulse generator.

18. A musical keyboard according to claim 14 wherein said sensor inductance coils are planar windings mounted on an insulating board.

19. A method for controlling a digitally interfaced musical instrument from a continuously sensed keyboard capable of transmitting digital signals representative of key position, key velocity, and key pressure, comprising the steps of:

(a) sequentially ascertaining the absolute position of each key in said keyboard;

(b) storing said ascertained key positions in a memory;

(c) after a known elapsed time period, again ascertaining the absolute position of each key in said keyboard;

(d) comparing said stored position for each of said keys with:

(1) said newly ascertained position, (2) a threshold value indicative of an inactive state, (3) a threshold value indicative of an active state, and (4) a threshold value indicative of an aftertouch (pressure) state; and (e) transmitting a digital message indicative of the state of each of said keys, said message including at least one of the parameters of key position, key velocity, and key pressure (aftertouch).

20. The method of claim 19 wherein said digital message conforms to MIDI specification 1.0 published by the International MIDI Association, 1983.

21. A system for controlling a digitally interfaced musical instrument from a continuously sensed keyboard capable of transmitting digital signals representative of key position, key velocity, and key pressure, comprising:

(a) means for sequentially ascertaining the absolute position of each key in said keyboard;

() means for storing said ascertained key positions;

(c) means for ascertaining after a known elapsed time period, the absolute position of each key in said keyboard;

(d) means for comparing said stored position for each of said keys with:

(1) said newly ascertained position, (2) a threshold value indicative of an inactive state, (3) a threshold value indicative of an active state, and (4) a threshold value indicative of an aftertouch (pressure) state; and (e) means for transmitting a digital message indicative of the state of each of said keys, said message including at least one of the parameters of key position, key velocity, and key pressure (aftertouch).

22. The system of claim 21 wherein said continuous sensor is an inductive tank circuit.

23. The system of claim 21 wherein said digital message conforms to MIDI specification 1.0 published by the International MIDI Association, 1983.

* * * * *